United States Patent [19]

Scribner

[11] 4,399,937

[45] Aug. 23, 1983

[54] HIGH SPEED DUAL SLIDE STOCK FEEDER

[76] Inventor: Albert W. Scribner, 6 Country Club Rd., Darien, Conn. 06820

[21] Appl. No.: 318,200

[22] Filed: Nov. 4, 1981

[51] Int. Cl.[3] ..... B65H 17/34; B65H 23/00

[52] U.S. Cl. ..... 226/162; 226/108; 226/115; 226/196; 226/199

[58] Field of Search ..... 226/162, 158, 144, 146, 226/108, 112, 115, 196, 199, 24, 25; 242/76

[56] References Cited

U.S. PATENT DOCUMENTS

| | | | |
|---|---|---|---|
| 3,485,430 | 12/1969 | Scribner | 226/162 X |
| 3,583,268 | 6/1971 | Scribner | 226/112 X |
| 3,692,223 | 9/1972 | Laigle et al. | 226/199 |
| 3,851,811 | 12/1974 | Turner | 226/199 |
| 3,972,461 | 8/1976 | Zahradnik et al. | 226/196 X |
| 4,051,987 | 10/1977 | Scribner | 226/146 X |
| 4,160,518 | 7/1979 | Scribner | 226/115 |
| 4,195,761 | 4/1980 | Scribner | 226/162 X |
| 4,261,786 | 4/1981 | Martin et al. | 226/196 X |
| 4,265,176 | 5/1981 | Sato | 226/196 X |
| 4,310,114 | 1/1982 | Scribner | 226/162 |

*Primary Examiner*—Stanley N. Gilreath

[57] ABSTRACT

An improved high speed pneumatic feeder for a punch press or the like wherein a novel combination of a pair of feed slides and a stock guide means extending longitudinally between said feed slides serves to prevent very thin strip stock from buckling while being rapidly pushed by the feed slides through the feeder.

4 Claims, 5 Drawing Figures

Fig. 1
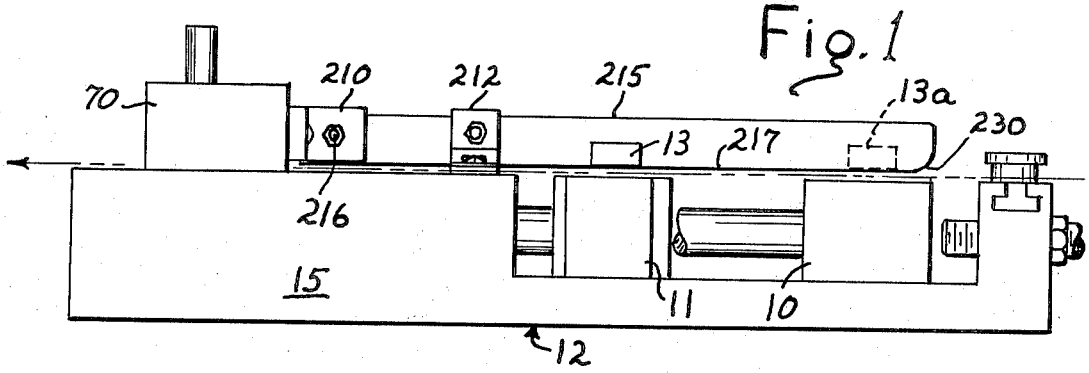
Fig. 2
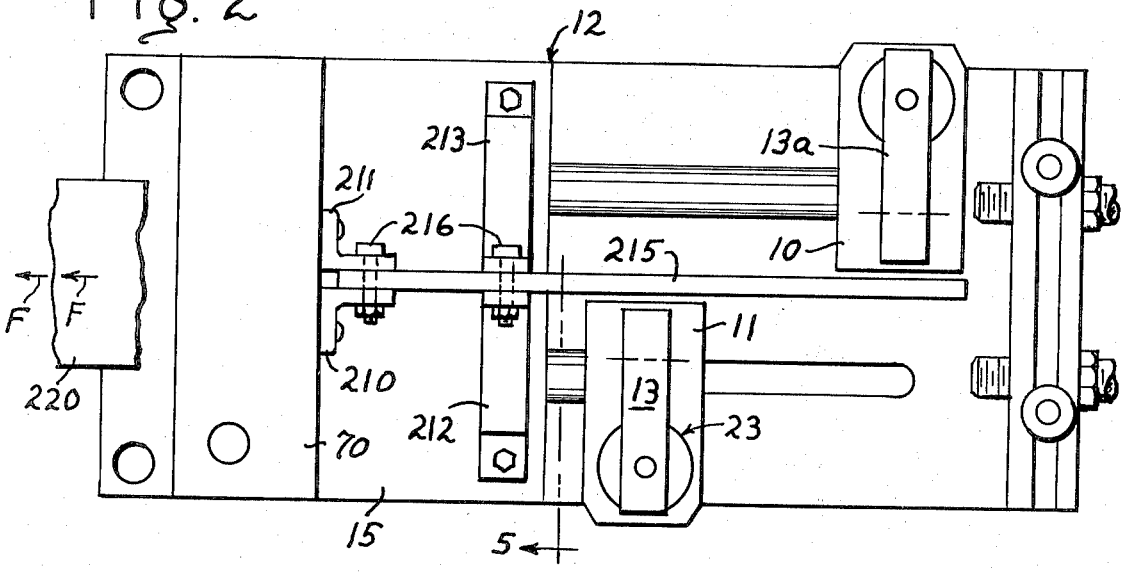
Fig. 3
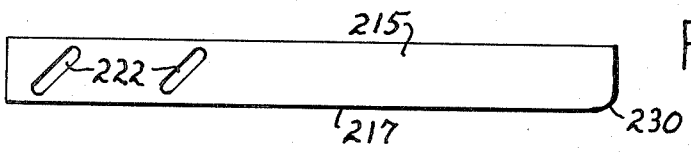
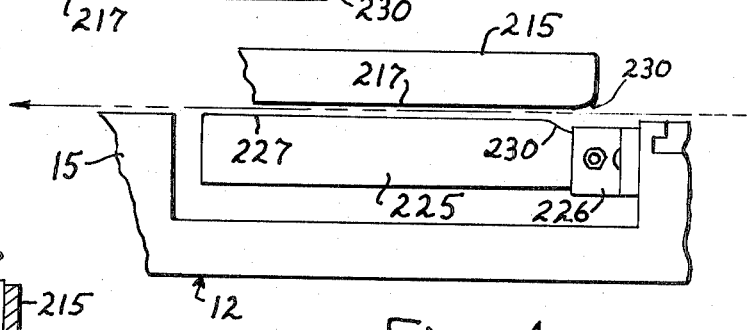
Fig. 4
Fig. 5
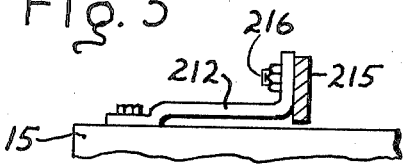

HIGH SPEED DUAL SLIDE STOCK FEEDER

BACKGROUND OF THE INVENTION

Strip stock, such as thin metal strip less than about 0.010 inches thick, that has little resistance to buckling when being intermittently advanced into the work station of a punch press or the like will be most apt to buckle if the incremental feed stroke length is relatively long, e.g. 2 inches, and the cyclic rate of feed is at the same time relatively high, e.g. 300 feed strokes per minute or higher. In a high speed dual slide feeder of the type illustrated in my copending application Ser. No. 06/116,548 filed Jan. 29, 1980 and entitled Control Arrangement for Dual Slide Pneumatic Feeders, now U.S. Pat. No. 4,310,114, the stock feed acceleration forces produced by each feed slide at the beginning of each feed stroke may produce a slight buckling of that portion of the stock just in front of the feed slide that is commencing the feed stroke. Even a slight buckling of this portion of the thin stock however may interfer with the simultaneous return movement of the other feed slide that is then just beginning its index or non-feed stroke; said other feed slide here attempting during its non-feed stroke to move past said buckling portion of the thin stock. When such buckling and interference occur both of said feed slides will become stalled in the course of their respective strokes and this is particularly undesirable during high speed operations not only because of the time and material waste involved but also because of the risk of damage to the feeder, to the more expensive tooling in the punch press with which the feeder is being used, and/or to the press itself.

SUMMARY OF THE INVENTION

The present invention contemplates eliminating the above noted problems associated with feed buckling of thin stock by providing a novel feed slide and stock guide arrangement for guiding in a predetermined plane that portion of the thin stock that is actually passing through the feeder. This novel feed slide and stock guide combination includes a blade-like guide member which is carried by the feeder frame and which extends along the surface of the longitudinal center region of that portion of the stock that is located laterally and longitudinally between the stock gripping means carried by the two feed slides whereby said portion of the stock is prevented from moving out of a predetermined plane during stock feeding operations.

DESCRIPTION OF THE DRAWINGS

FIG. 1 is a front elevational view of the present feeder and stock guide combination.

FIG. 2 is a plan view of the apparatus illustrated in FIG. 1.

FIG. 3 is a front elevation view illustrating means for permitting the vertical adjustment of the stock guide member relative to the feed slides.

FIG. 4 is a front elevation view illustrating an added stock guide member for guiding the lower stock surface through the feeder.

FIG. 5 is a fragmentary elevational view in partial section taken along section line 5 of FIG. 2.

DETAILED DESCRIPTION OF THE INVENTION

The present invention will be disclosed as embodying a dual slide pneumatic feeder of the type shown and described in said patent, the disclosure in said patent being incorporated herein by reference. Reference numerals used herein that are the same as those used in said patent designate the same or similar parts, and unless otherwise indicated the structure for the feeder contemplated herein will be the same or similar to that disclosed in said patent. Referring to FIGS. 1 and 2 a first pair of cooperating brackets 210, 211 is secured by any suitable means to the feeder valve block 70 of the type shown in U.S. Pat. No. 4,195,761, while a second pair of cooperating brackets 212, 213 is secured by any suitable means at their respective transverse outer ends to the top of the main body portion 15 of the feeder frame 12. A stock guide blade or member 215 is clamped between the adjacent inner ends of each of said pairs of brackets by means of screws 216 and associated nuts so that said blade 215 may be securely supported in a horizontal position as indicated in FIGS. 1 and 2 wherein its lower surface 217, FIGS. 1 and 3, extends horizontally and is disposed closely adjacent to the upper surface of the thin stock 220, FIG. 2, being fed through the feeder and into the press. Blade 215 extends from the valve block 70 centrally and longitudinally of the feeder and, as illustrated in FIGS. 1 and 2, between the inner mutually facing ends of the reciprocating stock gripping means 13 and **13*a* of the two feed slides 11 and 10 respectively. As illustrated herein and as shown and described in said U.S. Pat. No. 4,310,114 the feed slides 10 and 11 are laterally opposed, i.e. they are adapted to reciprocate in substantially parallel side-by-side paths. FIG. 3 illustrates a hole arrangement 222 in blade 215 that may be used to allow for vertical adjustment of the operative horizontal position for blade 215 and its lower edge 217 relative to said feed slides. FIG. 4 shows a corresponding lower blade or guide member 225 which may be supported at one or both ends thereof to the feeder frame by any suitable bracket or other means such as 226 so that its upper horizontal edge 227 may be vertically secured and, in the same manner as described for blade 215, vertically adjusted with respect to the lower surface of the strip 220 being fed; blade 225 being disposed substantially coplanar with respect to the upper blade 215. Each stock guide blade 215 and 225 is provided with an appropriate smooth taper 230 at its leading or operative right hand end as seen in FIGS. 2–4** so that the stock is initially smoothly engaged by the guides upon entering the feeder.

The configuration of brackets 212 and 213 is illustrated in FIG. 5 which is taken along the section line 5 shown in FIG. 2. Using the above described combination of laterally opposed feed slides and a stock guide means positioned therebetween both the upper and lower surfaces of the stock being intermittently advanced as indicated by arrows F of FIG. 2 will be guided so as to prevent the buckling thereof in the feeder; this greatly facilitating the efficient high speed feeding of thin stock into the work station of the punch press with which the present feeder is used.

I claim:

1. A pneumatic feeder for intermittently advancing thin stock into the work station of a punch press or the like: comprising the combination of a frame;

a cooperating pair of laterally opposed feed slides reciprocally mounted on said frame;

stock gripping means carried by each of said two feed slides, said stock gripping means having mutually facing inner ends; fluid motor means for actuating said stock gripping means; a main fluid motor means for actuating said two feed slides in opposed phase relation so that said feed slides one after the other may produce the successive stock feed strokes of the feeder, the resultant reciprocation of said stock gripping means with said feed slides thereby effectively defining a horizontal stock feed plane;

stock guide means carried by said frame for retaining the stock located in the feeder in said feed plane;

said stock guide means including a guide member supported so as to extend longitudinally of the feeder and between the mutually facing inner ends of said reciprocating stock gripping means;

said guide member having a horizontal edge surface that is adapted to be disposed immediately adjacent the surface of that longitudinal center portion of said stock that is located between the said inner ends of said two stock gripping means so as to prevent buckling of the successive portions of the stock located in the feeder during feed operations.

2. Apparatus as defined by claim 1 wherein said edge surface of said guide means is adapted to be disposed closely adjacent to the upper surface of the said stock in said feeder.

3. Apparatus as defined by claim 1 or 2 wherein said guide means includes a portion having a longitudinal edge surface that is adapted to be disposed closely adjacent to the lower surface of the said stock in said feeder and to extend between the inner ends of said feed slides.

4. Apparatus as defined by claim 1 or 2 additionally comprising means for permitting vertical adjustment of the operative horizontal position of said edge surface relative to said feed slides.

* * * * *